US010107099B2

(12) United States Patent
Offenburger et al.

(10) Patent No.: US 10,107,099 B2
(45) Date of Patent: Oct. 23, 2018

(54) HYDROSTATIC RADIAL PISTON MACHINE

(71) Applicant: Robert Bosch GmbH, Stuttgart (DE)

(72) Inventors: Johannes Offenburger, Glenrothes (GB); Heinz-Gerhard Essig, Lonsee (DE); Adam MacPhee, Kircaldy (GB)

(73) Assignee: Robert Bosch GmbH, Stuttgart (DE)

( * ) Notice: Subject to any disclaimer, the term of this patent is extended or adjusted under 35 U.S.C. 154(b) by 374 days.

(21) Appl. No.: 14/975,797

(22) Filed: Dec. 20, 2015

(65) Prior Publication Data

US 2016/0177719 A1 Jun. 23, 2016

(30) Foreign Application Priority Data

Dec. 22, 2014 (DE) ..... 10 2014 226 803

(51) Int. Cl.

| | |
|---|---|
| ***F01B 1/06*** | (2006.01) |
| ***F01B 9/06*** | (2006.01) |
| ***F03C 1/30*** | (2006.01) |
| ***F03C 1/34*** | (2006.01) |
| ***F03C 1/36*** | (2006.01) |
| ***F03C 1/047*** | (2006.01) |
| ***F03C 1/08*** | (2006.01) |

(52) U.S. Cl.

CPC ..... *F01B 9/06* (2013.01); *F01B 1/0603* (2013.01); *F01B 1/0606* (2013.01); *F03C 1/047* (2013.01); *F03C 1/0409* (2013.01); *F03C 1/0435* (2013.01); *F03C 1/0438* (2013.01); *F03C 1/0472* (2013.01); *F03C 1/08* (2013.01); *F01B 2009/061* (2013.01)

(58) Field of Classification Search

CPC ..... B60K 7/0015; F01B 1/06; F01B 1/0603; F01B 1/0606; F01B 9/06; F01B 2009/061; F03C 1/04; F03C 1/0409; F03C 1/0435; F03C 1/0438; F03C 1/047; F03C 1/0472; F03C 1/08; F04B 1/0465

See application file for complete search history.

(56) References Cited

U.S. PATENT DOCUMENTS 4,326,450 A * 4/1982 Bacquie ..... B60K 7/0015 91/487

5,176,511 A 1/1993 Bigo

FOREIGN PATENT DOCUMENTS

DE 10 2012 005 822 A1 9/2013

* cited by examiner

*Primary Examiner* — Logan Kraft

(74) *Attorney, Agent, or Firm* — Maginot, Moore & Beck LLP

(57) ABSTRACT

A hydrostatic radial piston machine is useable inversely. The hydrostatic radial piston machine has a distributor in which a flushing valve, a pressure-maintaining valve connected downstream of the flushing valve, and two nonreturn valves are arranged.

15 Claims, 8 Drawing Sheets

HYDROSTATIC RADIAL PISTON MACHINE

This application claims priority under 35 U.S.C. § 119 to patent application number DE 10 2014 226 803.6, filed on Dec. 22, 2014 in Germany, the disclosure of which is incorporated herein by reference in its entirety.

BACKGROUND

The disclosure is based on a hydrostatic radial piston machine, in particular a hydrostatic radial piston motor.

U.S. Pat. No. 5,176,511 discloses a hydrostatic radial piston machine in the form of an inverse radial piston motor which has a cylinder block with a multiplicity of pistons accommodated therein in cylinder spaces. Said pistons are mounted displaceably in a respective cylinder space and are each supported on a cam ring via a roller. The cylinder block is connected to a shaft for rotation therewith. Furthermore, a core element via which the cylinder spaces can be supplied with pressure medium is connected to the shaft and to the cylinder block for rotation therewith. The core element with the stepped outer lateral surface thereof is inserted here into a distributor with a stepped inner lateral surface. Annular grooves between the distributor and the core element are bounded via the steps, wherein a first annular groove is connected to a first main port, and a second annular groove is connected to a second main port, in each case via the core element and the shaft. Holes which are connected to the first and the second annular groove in an alternating manner, as seen in the circumferential direction, open into an end surface of the distributor, which end surface faces the cylinder block. A respective cylinder space in the cylinder block is then connectable to one of the holes via a pressure medium flow path. In the case of the inverse radial piston motor, the cam ring is rotatable with the distributor.

DE 10 2012 005 822 A1 discloses a further embodiment of a radial piston motor. A freewheel, in which the main ports are connected in an unpressurized manner and a leakage space is subjected to a pressure of, for example, 2 bar, is provided in the radial piston motor. By this means, the pistons move radially inward into the cylinder space thereof and no longer bear against the cam ring. A flushing valve is provided in order to avoid overheating. During the operation of the radial piston motor, said flushing valve opens a connection from the main port, which has higher pressure, to the leakage port via a pressure-maintaining valve with a nozzle. Flushing is likewise also made possible in the freewheel. For this purpose, a nonreturn valve is provided between the leakage port and the main port. By this means, fluid can then flow from the leakage port to the main port in freewheel.

It is disadvantageous in the embodiment with the flushing valve and nonreturn valve that the valves require a large amount of construction space and, in particular, are fluidically connected to the radial piston motor in a complicated manner in apparatus terms.

By contrast, the disclosure is based on the object of providing a radial piston motor which is configured in a simple manner in apparatus terms, wherein the intention is for flushing to be made possible in normal operation and/or in the freewheel.

This object is achieved with a radial piston machine according to the following description.

SUMMARY

According to the disclosure, a radial piston machine, in particular a radial piston motor, is provided with a housing.

A shaft is arranged in the housing, wherein housing and shaft are rotatable with respect to each other. The shaft is connected to a cylinder block for rotation therewith. Cylinder spaces are introduced into said cylinder block from the outer circumference, wherein a piston is arranged in particular in an approximately radially displaceable manner in a respective cylinder space. A respective piston is supportable on a housing-secured cam ring, in particular in each case via a roller. Furthermore, a distributor (distributor or commutator) is provided in order to fluidically connect the cylinder spaces to a first and a second main port. The housing-secured distributor engages around a core element via which the distributor is connectable to the main ports. According to the disclosure, a flushing valve and/or a pressure-maintaining valve are provided in the distributor. Alternatively or additionally, a nonreturn valve for the first main port and/or a nonreturn valve for the second main port can be arranged in the distributor.

This solution has the advantage that the flushing valve with the pressure-maintaining valve is integrated in a simple manner in apparatus terms in the radial piston machine to provide the flushing function during normal operation thereof. By this means, fewer components are required, and the radial piston machine is furthermore configured to be extremely compact. Additionally or alternatively, one nonreturn valve or a plurality of nonreturn valves can be integrated in the distributor to provide the flushing function during a freewheel. Furthermore, the integration of the valves into the distributor reduces a risk in respect of external leakage of the radial piston machine. Since the valves are arranged in the distributor, an intersection between the valves and the housing is also no longer necessary. The radial piston machine with the flushing function therefore has a comparatively small number of components, has a low weight and a lower risk in respect of external leakage. Furthermore, it can be fitted more simply and rapidly and more cost-effectively in comparison to known solutions, in particular because of the smaller number of components. Furthermore, the integration of one or more of the valves in the distributor can result in a better mass distribution or in a better balance within the radial piston motor, which is extremely advantageous in the case of an inverse radial piston motor.

The distributor preferably has a stepped inner lateral surface, in particular with approximately cylindrical steps. A first step here together with the core element bounds a first annular groove, which is connectable to the first main port, and a second step having a smaller diameter together with the core element can bound a second annular groove which is connectable to the second main port. The distributor can therefore be connected to the main ports in any relative position to the core element, as seen in the circumferential direction. The flushing valve can then be connected to the first annular groove via a first pressure medium flow path and to the second annular groove via a second pressure medium flow path.

In a further refinement of the disclosure, a valve slide of the flushing valve is displaceable from a basic position in the direction of a first valve slide position in which a pressure medium connection between the second annular groove and an inlet port of the pressure-maintaining valve is open. In the opposite direction, the valve slide can be displaced from the basic position to a second valve slide position in which a pressure medium connection between the first annular groove and the inlet port of the pressure-maintaining valve is opened. In the basic position, the pressure medium connections are preferably shut.

The valve slide of the flushing valve can be arranged in an axially displaceable manner in a valve slide bore which is introduced into the distributor and which is in particular a blind hole bore.

The valve slide is preferably acted upon by the pressure medium of the first annular groove in the direction of the first valve slide position and by the pressure medium of the second annular groove in the direction of the second valve slide position.

Advantageously in apparatus terms, the valve slide bore is introduced into the distributor approximately level with the first annular groove or level with the second annular groove, as seen in the axial direction of the radial piston motor. A fluidic connection between the valve slide bore and one of the adjacent annular grooves is therefore made possible in a simple manner in apparatus terms, for example via a single bore.

The valve slide bore advantageously extends in a space-saving manner approximately tangentially—and in particular at a radial distance—to the inner lateral surface of the distributor.

Two connection bores extending approximately at a parallel distance to each other can open in the valve slide bore approximately transversely with respect to the valve slide bore in order to form the pressure medium flow paths. Said connection bores are preferably introduced into the distributor from the outside and can be closed to the outside via stoppers. They preferably lie approximately in a plane with the valve slide bore and the annular groove which is adjacent thereto.

The first connection bore can be connected via a preferably axial first connecting bore to a further second connecting bore, which opens, in particular transversely, in the first annular groove, in order to form the first pressure medium flow path. The second connection bore is preferably connected directly to the second annular groove by opening into the latter.

The valve slide of the flushing valve is preferably spring-centered in its basic position via two springs or alternatively via a double action spring.

In order to actuate the valve slide, the latter is connected via the first end side thereof to the first annular groove or to the first connection bore and via the second end side thereof to the second annular groove or to the second connection bore. The connection takes place here preferably via the valve slide by pressure medium paths being introduced on the outer circumference thereof or in sections within the valve slide.

Holes, in particular blind holes, for supplying pressure medium to the cylinder spaces in the distributor, are advantageously formed between the valve slide bore of the flushing valve and the annular grooves, as seen in the axial direction.

In a further refinement of the disclosure, the pressure-maintaining valve has a valve bore, which is introduced into the distributor, for a valve body. The valve bore can open in the valve slide bore of the flushing valve, and therefore, in addition to the receptacle for the valve body, the valve bore therefore also forms a fluidic port to the flushing valve. Via the valve slide of the flushing valve, the valve slide bore is then fluidically connectable in the first valve slide position thereof to the second annular groove and in the second valve slide position thereof to the first annular groove.

The valve bore of the pressure-maintaining valve can be introduced from an end side of the distributor approximately at a parallel distance to the longitudinal axis of the distributor.

In a simple manner in apparatus terms, the valve bore is of stepped designed, and therefore a valve seat for the valve body is provided at the step transition. The valve body can be acted upon with a spring force of a valve spring in the direction of the valve seat and in the direction of the flushing valve. In the opening direction, the valve body can then be acted upon by the pressure medium on the outlet side of the flushing valve, i.e. by the pressure medium of the first or second annular groove. On the outlet side, the pressure-maintaining valve is connected to a leakage port. On the inlet side, the pressure-maintaining valve has a restrictor which is formed, for example, on the valve body. In a simple manner in apparatus terms, the valve bore of the pressure-maintaining valve is closable by a stopper on which the valve spring can then also be supported.

The nonreturn valve for the first main port is preferably arranged in the pressure medium flow path between the first annular groove and a leakage port. The second nonreturn valve for the second main port can then be arranged in the pressure medium flow path between the second annular groove and the leakage port. A respective nonreturn valve advantageously opens in the flow direction toward the respective annular groove, and therefore, for example in the free wheel, pressure medium can flow from the leakage port to the main ports.

For the arrangement of a respective nonreturn valve, a valve bore, in particular in the form of a blind hole bore, is introduced in each case into the distributor. A respective valve bore extends here preferably approximately at a parallel distance to the longitudinal axis of the distributor.

The valve bore for the first nonreturn valve preferably extends from the first end side of the distributor, and the valve bore for the second nonreturn valve extends from a second end side of the distributor, which end side can face away from the first end side.

A valve seat is formed within a respective valve bore of a respective nonreturn valve, in particular by means of a hollow screw. The valve seat can be assigned a valve body which is acted upon by a spring force of a valve spring supported on the bore base.

For simple connection of the nonreturn valves to the annular grooves, a connecting bore extends from a respective valve bore to the respective annular groove. The valve bores are preferably introduced into the distributor from an outer lateral surface of the latter and can extend approximately radially.

The flushing valve together with the pressure-maintaining valve is preferably arranged on one side of the distributor and the nonreturn valves are arranged approximately diametrically on another side of the distributor. The valves are preferably arranged in such a manner that the distributor is designed as compactly as possible.

In a further refinement of the disclosure, the valve body of the pressure-maintaining valve and the valve bodies of the nonreturn valves are designed identically, which results in a low outlay in terms of apparatus.

Other advantageous developments of the disclosure are the subject matter of the following description.

An exemplary embodiment of a radial piston machine according to the disclosure is illustrated in the drawings. The disclosure is explained in more detail with reference to the figures of said drawings.

DETAILED DESCRIPTION

Figure 1:
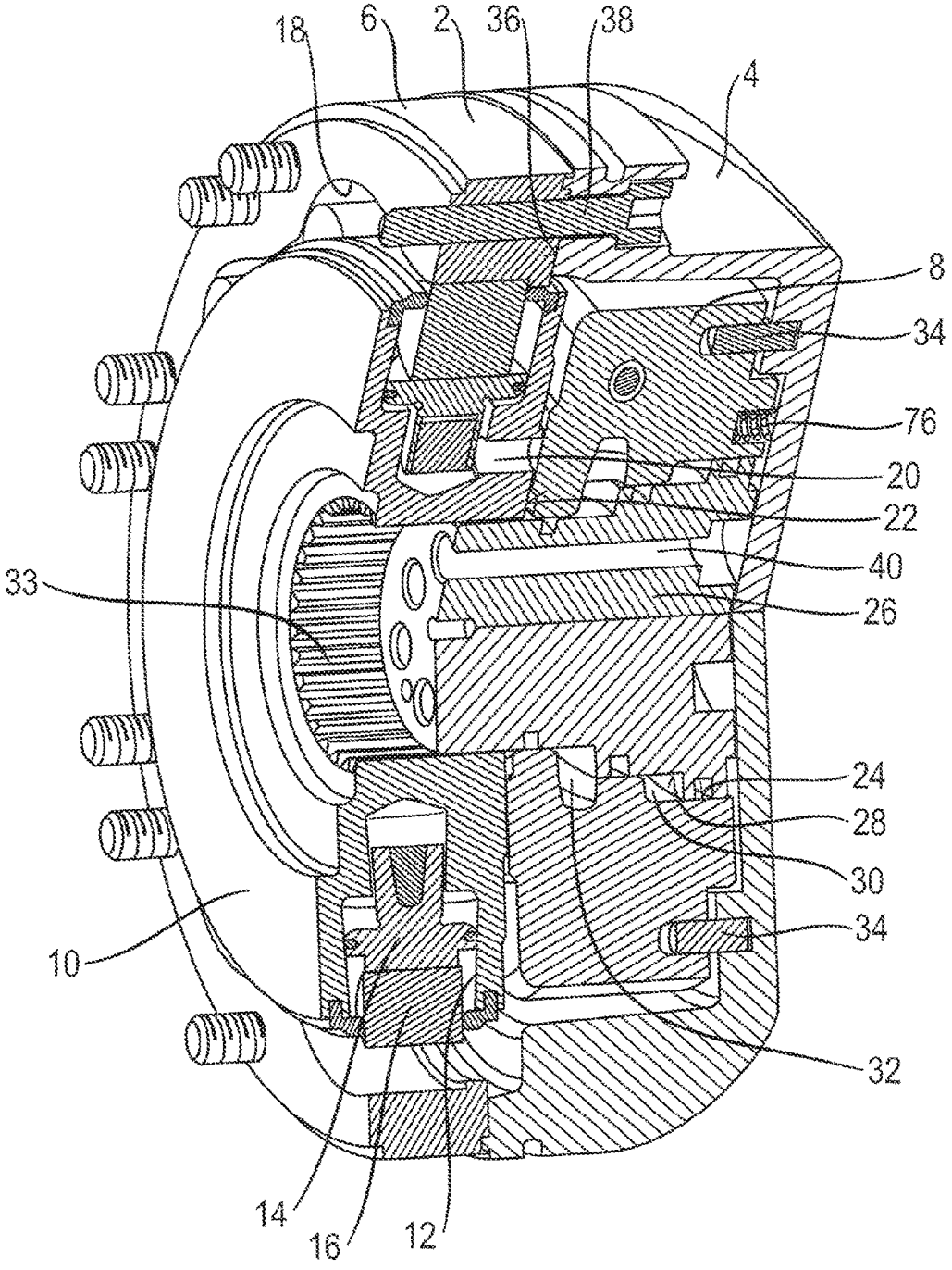
FIG. 1 shows a perspective illustration of a detail of a radial piston machine according to an exemplary embodiment.

In FIG. 1, a radial piston machine in the form of a radial piston motor 1 has a rotatable housing 2. The latter has a shell-shaped, rear housing part 4, which is connected non-rotatably to a cam ring 6 arranged on the end side, and a distributor 8 arranged within the housing part 4. The distributor 8 interacts fluidically with a cylinder block 10, around which the cam ring 6 engages. A multiplicity of cylinder spaces 12 extending approximately in the radial direction and in each of which a piston 14 is arranged displaceably are introduced within the cylinder block 10 from the outside. A respective piston 14 can be supported on a cam curve 18 of the cam ring 6 via an approximately circular-cylindrical roller 16. For the fluidic connection of the cylinder spaces 12 to the distributor 8, an axial bore 20 is introduced for a respective cylinder space 12 into the cylinder block 10, said axial bore opening at one end in the cylinder space 12 and at the other end in an end surface 22 of the cylinder block 10, which end surface faces the distributor 8.

The distributor 8 has a stepped inner lateral surface 24 which expands in a direction away from the cam ring 6. A core element 26 which has a stepped outer lateral surface 28 matched to the inner lateral surface 24 is inserted in the distributor 8. The core element 26 projects out of the distributor 8 and into a serration 30 of the cylinder block 10 and is connected non-rotatably to the latter. The distributor 8 with the core element 26 bounds a first annular groove 30 having a large diameter and a second annular groove 32 having a smaller diameter. The annular groove 28 is connected to a first main port A via a pressure medium flow path formed in the core element 26. The second annular groove 32 is connected to a second main port via a further pressure medium flow path introduced into the core element 26. Furthermore, the annular grooves 30 and 32 are fluidically connectable to the cylinder spaces 12 of the cylinder block 10 via the distributor block 8.

The distributor 8 is connected to the rear housing part 4 via centering bolts 34. The cam ring 6 then bears against an end surface 36 of the housing part 4 and is connected to the housing part 4 via a multiplicity of bolts 38. The bolts 38 pass completely through the cam ring 6 and project therefrom in the axial direction.

The core element 26 can additionally be fluidically connected to a shaft (not illustrated) for the pressure medium supply of the annular grooves 30 and 32, wherein the shaft can engage in the serrated connection 33.

Furthermore, the core element 26 has at least one leakage port 40 in addition to the main ports.

Figure 2:
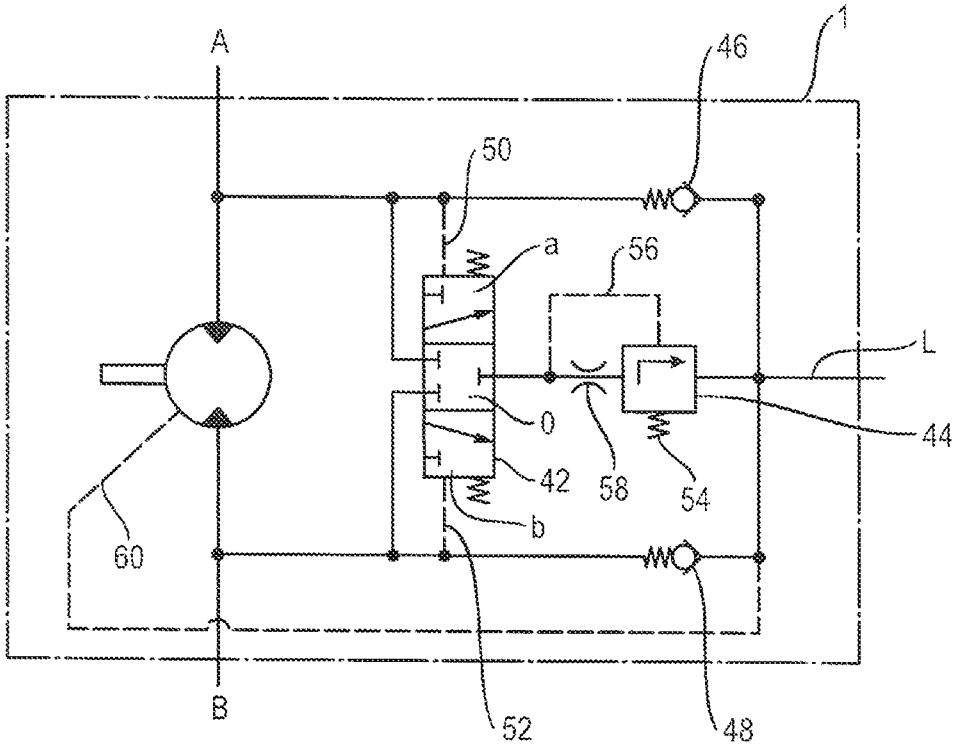
FIG. 2 shows a hydraulic circuit diagram of the radial piston machine according to the disclosure according to the exemplary embodiment.

According to FIG. 2, the radial piston motor 1 has a flushing valve 42, to which a pressure-maintaining valve 44 is connected downstream. Furthermore, it has a first nonreturn valve 46 and a second nonreturn valve 48. The valves 42 to 48 are arranged here, according to the disclosure, in the distributor 8 from FIG. 1. The flushing valve 42 together with the pressure-maintaining valve 44 can be used during normal operation of the radial piston motor. The flushing valve 42 is configured here as a 3/3-way directional control valve. In a spring-centered basic position 0 of the valve slide, the pressure medium connection between the main ports A, B and the pressure-maintaining valve 44 is blocked. If the valve slide is displaced from the basic position 0 in the direction of a first valve slide position a, a pressure medium connection between the second main port B and the pressure-maintaining valve 44 is opened. If the valve slide is displaced in the opposite direction from the basic position 0 in the direction of a second valve slide position b, it opens up a pressure medium connection between the first main port A and the pressure-maintaining valve 44. The valve slide can be acted upon in the direction of the first valve slide position a by pressure medium of the first main port via a control line 50 and in the direction of the second valve slide position b by the pressure medium of the second main port B via a control line 52. During the operation of the radial piston motor 1, the main port A or B which is lower in pressure is therefore connected to the pressure-maintaining valve 44.

The pressure-maintaining valve 44 has a continuously adjustable valve slide which is prestressed into a closed position via a valve spring 54. The valve slide can be acted upon counter to the spring force by the pressure medium on the outlet side of the flushing valve 42 via a control line 56. A restrictor 58 is arranged between the branching of the control line 56 and the valve slide. The valve slide can control a pressure medium connection between the restrictor 58 and a leakage port L of the distributor 8. The pressure-maintaining valve 44 customarily opens at a pressure of approximately 14 bar.

The radial piston motor 1 from FIGS. 1 and 2 can also be used in the free wheel, in which a leakage space is acted upon with a pressure, for example at the level of 2 bar, and the main ports A and B are connected to each other. By this means, the pistons 14 from FIG. 1 move radially inward and are therefore spaced apart from the cam ring 6. In order also in this state to permit flushing of the radial piston motor 1, the nonreturn valves 46 and 48 from FIG. 2 are provided. The first nonreturn valve 46 is arranged here in the pressure medium flow path between the leakage port L and the main port A, and the second nonreturn valve 48 is arranged in the pressure medium flow path between the leakage port L and the second main port B. The nonreturn valve 46 then opens in a pressure medium flow direction toward the first main port A and the second nonreturn valve 48 opens in a pressure medium flow direction toward the second main port B. In the free wheel, pressure medium can therefore flow from a leakage side 60 of the radial piston motor 1 for flushing purposes to the main ports and via the latter, for example, to a tank.

Figure 3:
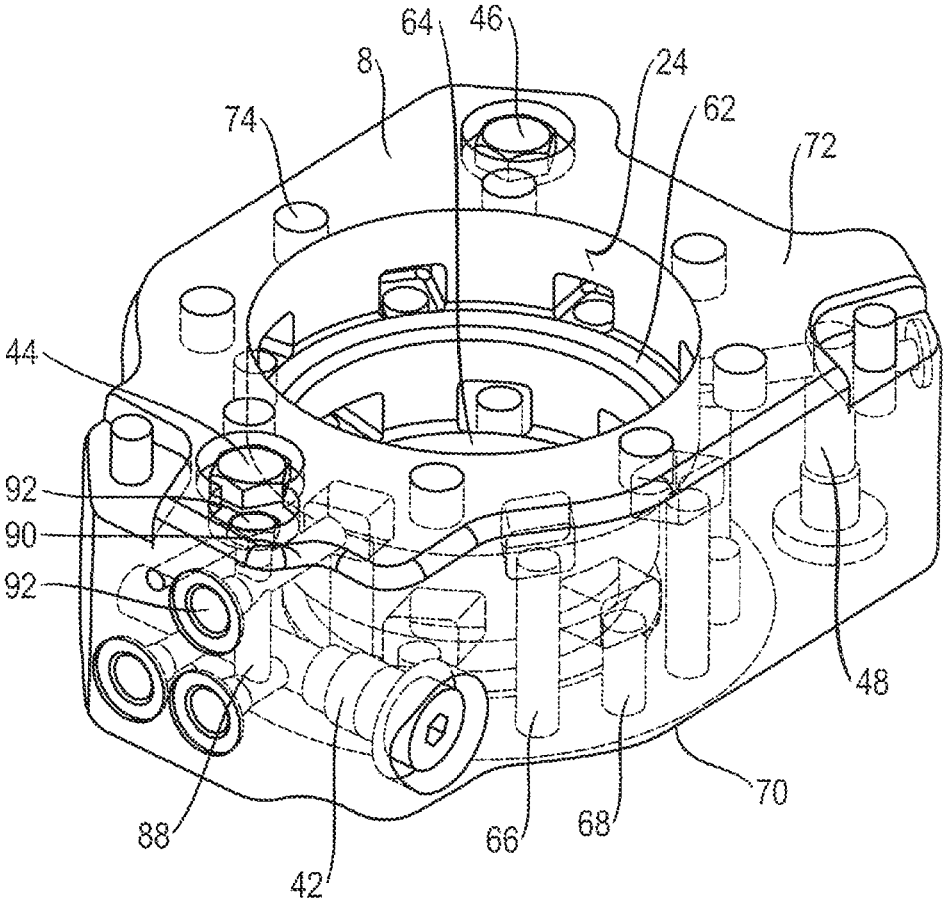
FIG. 3 shows a perspective illustration of a distributor of the radial piston machine according to the exemplary embodiment.

According to FIG. 3, the flushing valve 42, the pressure-maintaining valve 44, the first nonreturn valve 46 and the second nonreturn valve 48 are arranged in the distributor 8. The distributor 8 is preferably manufactured from a casting, in particular a metal casting. The inner lateral surface 24 of the distributor 8 has a first step 62 and a second step 64. The first step 62 here bounds the first annular groove 30 and the second step 64 bounds the second annular groove 32, see FIG. 1. A multiplicity of axial bores 66 and 68 are introduced into the distributor 8 in an alternating manner, as seen in the circumferential direction, on a pitch circle and open into an end side 70 of the distributor 8, which end side faces the cylinder block 10 from FIG. 1. The first axial bores 66 are connected here to the first annular groove 30 from FIG. 1 and the second axial bores 68 are connected to the second annular groove 32 from FIG. 1. One axial bore pair 66, 68 is customarily provided per cam of the cam ring 6 from FIG. 1. A multiplicity of blind hole bores 74, arranged on a pitch circle, are introduced from an end side 72 of the distributor 8, the end side facing away from the end side 70. A spring 76 which is supported on the housing part 4 is inserted here into a respective blind hole bore 74, according to FIG. 1.

Figure 4:
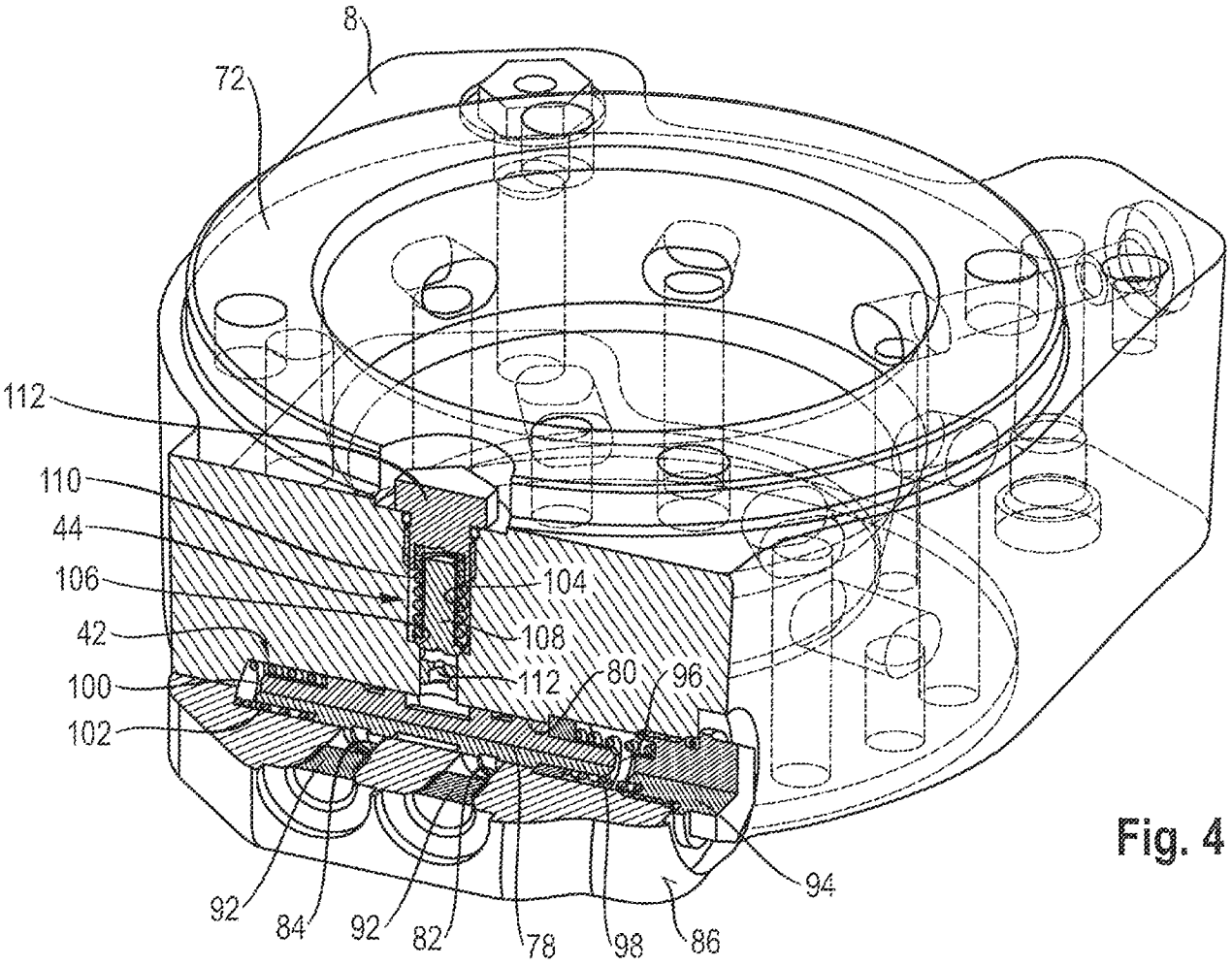
FIG. 4 shows a perspective illustration of the distributor with a detail in the region of a flushing valve and pressure-maintaining valve.

In FIG. 4, the flushing valve 42 has a valve slide 78 which is accommodated displaceably in a valve bore 80. The valve bore 80 extends approximately tangentially to the inner lateral surface 24, wherein the axial bores 66, 68 are arranged between the valve bore 60 and the inner lateral surface 24 in this region. A first connection bore 82 and a second connection bore 84, which are formed approximately at a parallel distance to each other, open approximately transversely with respect to the valve bore 80. Said connection bores are introduced from an outer lateral surface 86 of the distributor 8. The second connection bore 84 passes through the valve bore 80 and opens into the second step 64 from FIG. 3, where it is connected to the second annular groove 32. By contrast, according to FIG. 3, the first connection bore 82 is connected via a first connecting bore 88 and via a second connecting bore 90 to the first step 62 and therefore to the first annular groove 30. The connecting bore 88 is introduced in each case as a blind hole bore from the end side 72 and extends approximately at a parallel distance to a longitudinal axis of the distributor 8. The further connecting bore 90 is introduced into the distributor 8 from the outer lateral surface 86 and extends approximately at a parallel distance to the connection bore 82. The connection bores 82, 84 are each closed to the outside via a stopper 92. The same applies to the connecting bores 88 and 90 which are likewise closed to the outside via a stopper 92. The valve bore 80 is therefore connected to the annular grooves 30 or 32 via the connection bores 82 and 84. Then, as described in FIG. 2, the valve slide 78 can use control edges either to connect the first connection bore 82 or the second connection bore 84 to the pressure-maintaining valve 44 or to block the connection between the pressure-maintaining valve 44 and the connection bores 82, 84. The valve bore 80 is closed to the outside via a closure element 94.

The first end side 96 of the valve slide 78 bounds a spring space in which a valve spring 98 is arranged. Another end side 100 of the valve slide 78 bounds a further spring space in which a further valve spring 102 is arranged. The valve slide 78 is spring-centered in the basic position 0 thereof via the valve springs 98 and 102. The end side 96 is acted upon with pressure medium from the first connection bore 82 via the valve slide 78 and the end side 100 is acted upon with pressure medium from the second connection bore 84 via the valve slide 78.

A valve bore 104 is provided for the pressure-maintaining valve 44. Said valve bore is introduced from the end side 72 of the distributor 8 and opens in the valve bore 80. The end side 72 faces away from the cylinder block 10 according to FIG. 1. A mouth of the valve bore 104 is arranged between the mouths of the connection bores 82 and 84, as seen in the axial direction of the valve bore 80. The valve bore 104 is of stepped design, wherein a step transition is provided as valve seat 106. The latter is assigned a valve body 108. The latter is acted upon in the direction of the valve seat 106 by a spring force of a valve spring 110. Said valve spring is supported on a closure element 112 for the valve bore 104. Furthermore, a restrictor 112 is formed on the valve body 108, via which restrictor pressure medium can flow from the flushing valve 42 to the leakage port L in the open state of the valve body 8, see FIG. 2.

Figure 5:
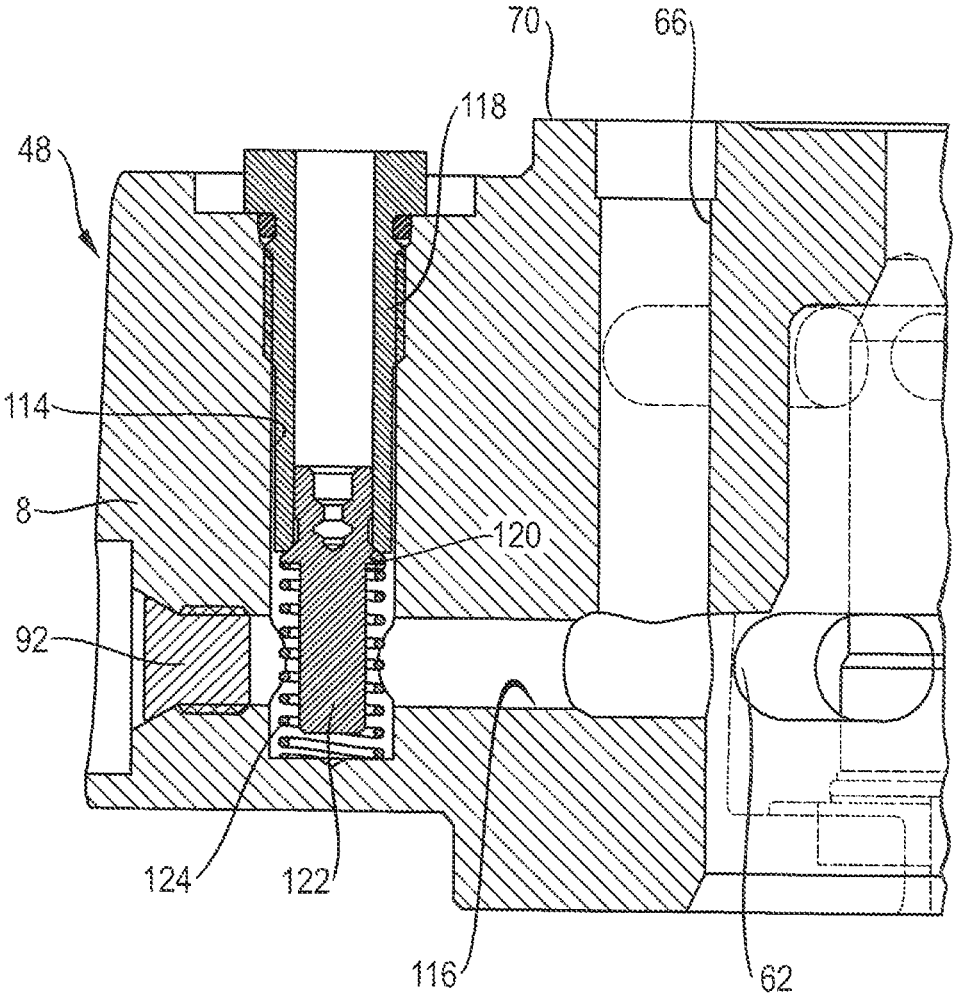
FIG. 5 shows a longitudinal section of a detail of the distributor from FIG. 4 in the region of a nonreturn valve.

The nonreturn valve 48 from FIG. 3 is shown according to FIG. 5. A valve bore 114 which is configured as a blind hole bore and is introduced from the end side 70 of the distributor 8 is provided for the nonreturn valve 48, wherein the end side 70 according to FIG. 1 faces the cylinder block 10. The valve bore 114 is penetrated by a connecting bore 116 which opens in the first step 62. A hollow screw 118 which forms a valve seat 120 on the end side is screwed into the valve bore 114. The valve seat 120 is assigned a valve body 122 which is designed according to the valve body 108 from FIG. 4 of the pressure-maintaining valve 44. The valve body 122 is acted upon in the direction of the valve seat 120 with a spring force of a valve spring 124. The valve spring 124 is supported here on a bore base of the valve bore 114. The hollow screw 118 forms a port to the leakage side of the radial piston motor 1. The spring space receiving the valve spring 124 is then connected to the first step 62 via the connecting bore 116. The connecting bore 116 is closed outward via the stopper 92. The axial bore 66, also see FIG. 3, can additionally be seen according to FIG. 5.

The further nonreturn valve 46 according to FIG. 3 is designed according to the nonreturn valve 48, wherein the valve bore of said further nonreturn valve is introduced from the other end side 72. In addition, the connecting bore of the nonreturn valve 46 is connected to the second step 64. By introduction of the valve bores of the nonreturn valves 46 and 48 from different end sides 70 and 72, the respective valve bore can be connected on the end side to the respective annular groove 30, 32 by just one connecting bore.

Figure 6:
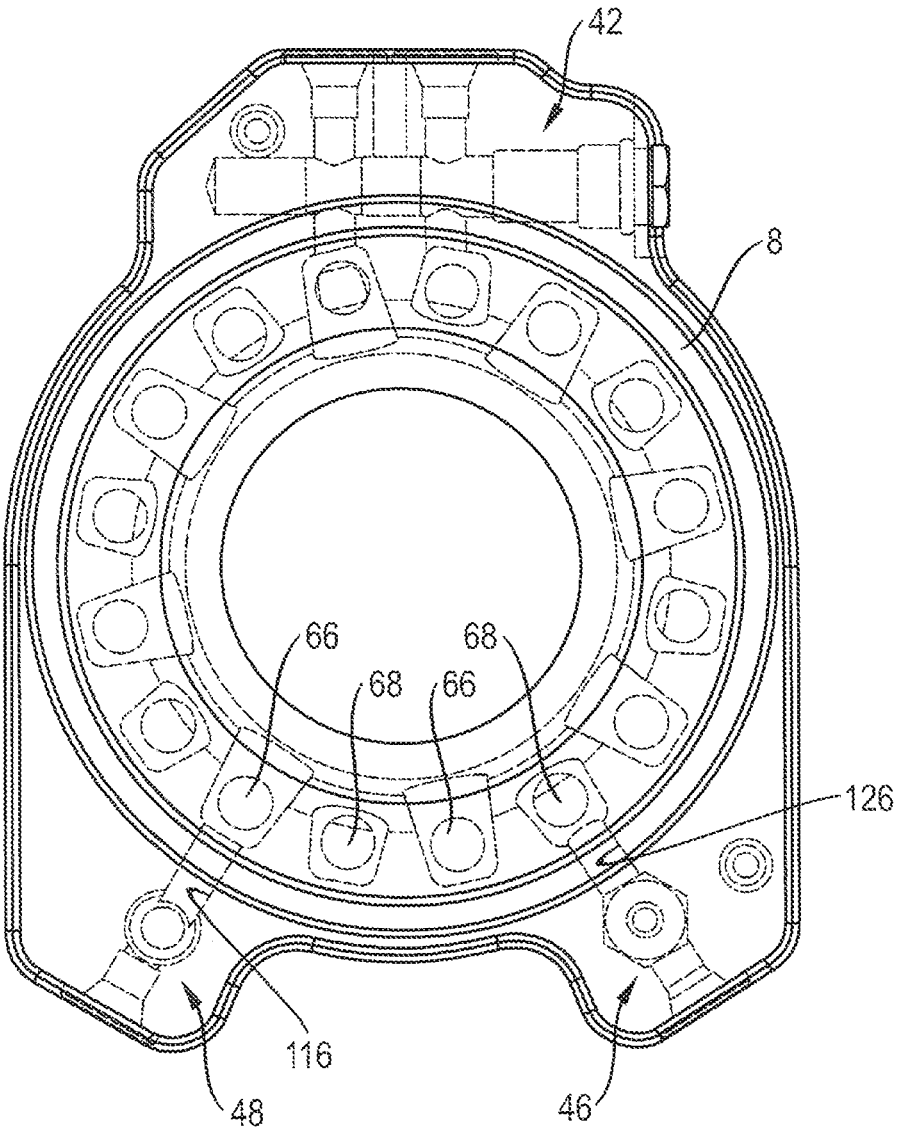
FIG. 6 shows a top view of the distributor from FIG. 4, FIGS. 7 and 8 each show a perspective illustration of a rear housing part of the radial piston machine from FIG. 1.

The arrangement of the nonreturn valves 46, 48 and of the flushing valve 42 in the distributor 8 can be seen according to FIG. 6. The connecting bore 116 of the nonreturn valve 48 extends approximately in the radial direction. The same applies to the connecting bore 126 of the nonreturn valve 46. The connecting bore 116 opens, according to FIG. 6, in the axial bore 66 and the connecting bore 126 opens in the axial bore 68. Two further axial bores 66, 68 are provided between the connecting bores 116 and 126, as seen in the circumferential direction. The flushing valve 42 and the pressure-maintaining valve (not illustrated in FIG. 6) are formed on the distributor 8 approximately diametrically to the nonreturn valves 46 and 48.

Figure 7:
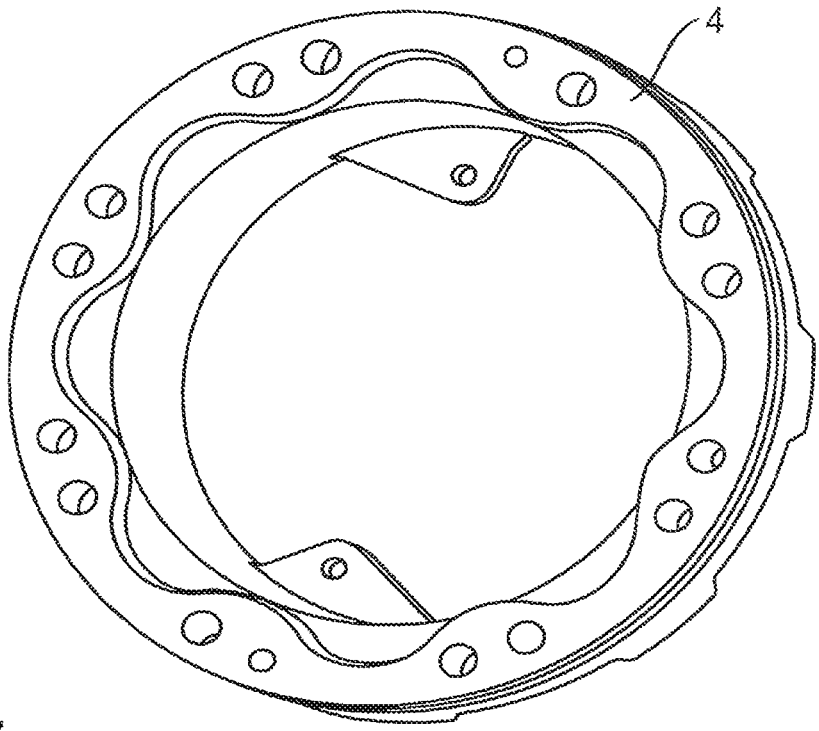
Figure 8:
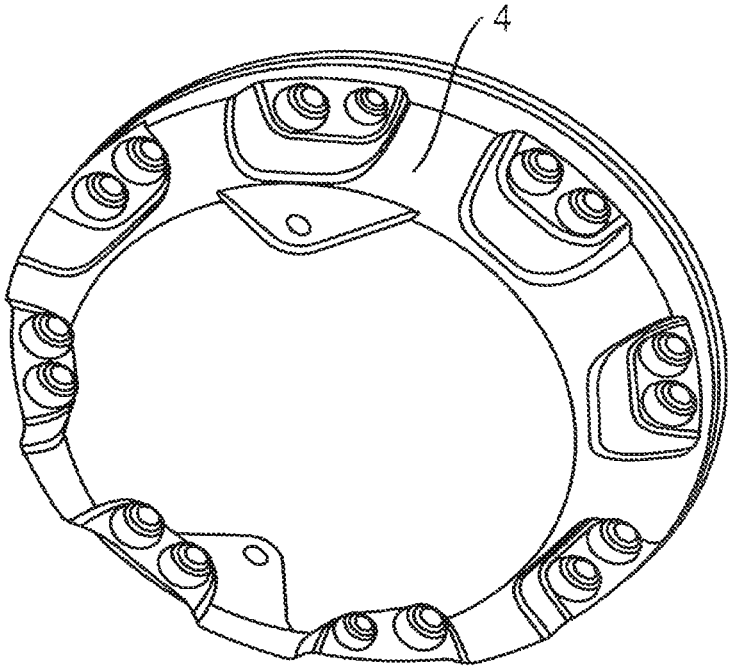

The cup-shaped housing part 4 is illustrated according to FIG. 7. Since the valves 42 to 48, see FIG. 3, are arranged within the distributor 8, it is advantageously not necessary to provide hydraulic intersections to the distributor 8 in the housing part 4, and therefore said housing part is designed extremely simply. Said housing part can therefore be produced in a simple manner and furthermore has a low weight. An end covering for the radial piston motor 1 is also no longer necessary. Since an intersection is not necessary, a seal for the intersection between the distributor 8 and the housing part 4 is not required either. According to FIG. 8, the housing part 4 is illustrated from a rear side.

Figure 9:
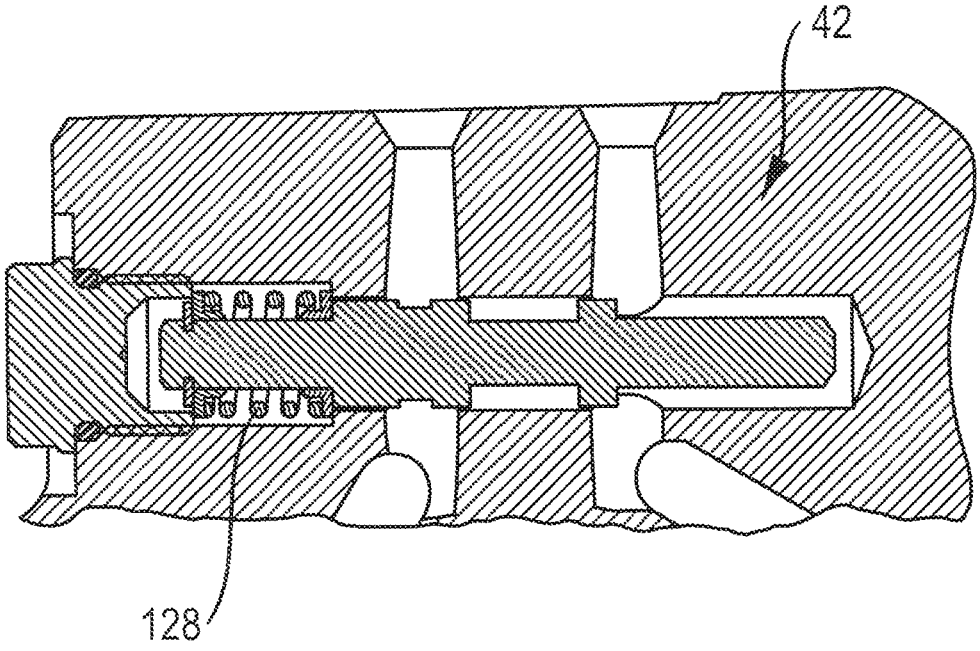
FIG. 9 shows a longitudinal section of a detail of the distributor in the region of an alternatively designed flushing valve.

In FIG. 9, in contrast to FIG. 4, the flushing valve 42 has only one valve spring 128 which has a double action. A radial piston machine which is usable inversely is disclosed. The radial piston machine has a distributor in which a flushing valve, a pressure-maintaining valve connected downstream of the flushing valve, and two nonreturn valves are arranged.

The valves 42, 44, 46 and 48 are arranged outside the axial bores 66, 68, as seen in the radial direction of the distributor 8.

The radial piston motor 1 can be used, for example, for a hydraulic driving assistant.

A radial piston machine which is usable inversely is disclosed. The radial piston machine has a distributor in which a flushing valve, a pressure-maintaining valve connected downstream of the flushing valve, and two nonreturn valves are arranged.

LIST OF REFERENCE SIGNS

1 radial piston motor
2 housing
4 housing part
6 cam ring
8 distributor
10 cylinder block
12 cylinder space
14 piston
16 roller
18 cam curve
20 axial bore
22 end surface
24 inner lateral surface
26 core element
28 outer lateral surface
30 first annular groove
32 second annular groove
33 serrated connection
34 centering bolt
36 end surface
38 bolt
40 leakage port
42 flushing valve
44 pressure-maintaining valve
46 first nonreturn valve
48 second nonreturn valve
50 control line
52 control line
54 valve spring
56 control line
58 restrictor
60 leakage side
62 first step
64 second step
66 axial bore
68 axial bore
70 end side
72 end side
74 blind hole bores
76 spring
78 valve slide
80 valve bore
82 first connection bore
84 second connection bore
86 outer lateral surface
88 connecting bore
90 connecting bore
92 stopper
94 closure element
96 end side
98 valve spring
100 end side
102 valve spring
104 valve bore
106 valve seat
108 valve body
110 valve spring
112 restrictor
114 valve bore
116 connecting bore
118 hollow screw
120 valve seat
122 valve body
124 valve spring
126 connecting bore
128 valve spring
A first main port
B second main port
L leakage port
a first valve slide position
b second valve slide position
0 basic position

What is claimed is:

1. A hydrostatic radial piston machine, comprising:

a rotatable housing in which a cylinder block is arranged, cylinder block pistons displaceably arranged in the cylinder block, the pistons supportable on a housing-secured cam ring and each piston bounding a cylinder space in the cylinder block, wherein the cylinder spaces are connectable to a first and second main port via a housing-secured distributor configured to supply pressure medium, wherein a core element is inserted into the distributor and is configured to connect the distributor to the first and second main ports, the core element configured for rotation relative to the distributor, and wherein at least one of a flushing valve, a pressure-maintaining valve, and a nonreturn valve for the first main port is arranged in the distributor, and wherein a nonreturn valve for the second main port is arranged in the distributor.

2. The hydrostatic radial piston machine according to claim 1, wherein:

the distributor with the core element bounds a first annular groove which is connectable to the first main port, the distributor together with the core element bounds a second annular groove, which is connectable to the second main port, and the flushing valve is connected to the first annular groove via a first pressure medium flow path and is connected to the second annular groove via a second pressure medium flow path.

3. The hydrostatic radial piston machine according to claim 1, wherein the flushing valve and the pressure-maintaining valve are arranged on the distributor approximately diametrically with respect to the nonreturn valves.

4. The hydrostatic radial piston machine according to claim 1, wherein the pressure-maintaining valve and the nonreturn valves have an identical valve body.

5. The hydrostatic radial piston machine according to claim 1, wherein the flushing valve, the pressure-maintaining valve, the nonreturn valve for the first main port, and the nonreturn valve for the second main port are arranged in the distributor.

6. A hydrostatic radial piston machine, comprising:

a rotatable housing in which a cylinder block is arranged, cylinder block pistons displaceably arranged in the cylinder block, the pistons supportable on a housing-secured cam ring and each piston bounding a cylinder space in the cylinder block, wherein the cylinder spaces are connectable to a first and second main port via a housing-secured distributor configured to supply pressure medium, wherein a core element is inserted into the distributor and is configured to connect the distributor to the first and second main ports, the core element configured for rotation relative to the distributor, and wherein at least one of a flushing valve, a pressure-maintaining valve, and a nonreturn valve for the first main port is arranged in the distributor, wherein a nonreturn valve for the second main port is arranged in the distributor, wherein the flushing valve has a valve slide which is arranged in an axially displaceable manner in a valve slide bore introduced into the distributor, and wherein the valve slide bore extends approximately tangentially with respect to an inner lateral surface of the distributor.

7. The hydrostatic radial piston machine according to claim 6, wherein the valve slide bore is introduced into the distributor approximately level with the first annular groove or approximately level with the second annular groove, as seen in the longitudinal direction of the radial piston machine.

8. The hydrostatic radial piston machine according to claim 6, wherein two connection bores extending approximately at a parallel distance to each other open into the valve slide bore approximately transversely with respect to the valve slide bore to form the pressure medium flow paths.

9. The hydrostatic radial piston machine according to claim 8, wherein:

the first connection bore is connected via a first connecting bore to a second connecting bore which opens in the first annular groove, to form the first pressure medium flow path, and the second connection bore opens in the second annular groove.

10. The hydrostatic radial piston machine according to claim 6, wherein the pressure-maintaining valve has a valve bore, which is introduced into the distributor, for a valve body.

11. The hydrostatic radial piston machine according to claim 10, wherein the valve bore opens in the valve slide bore of the flushing valve.

12. The hydrostatic radial piston machine according to claim 10, wherein the valve bore of the pressure-maintaining valve is introduced from an end side of the distributor and is approximately parallel to the longitudinal axis of the distributor.

13. A hydrostatic radial piston machine, comprising:

a rotatable housing in which a cylinder block is arranged, cylinder block pistons displaceably arranged in the cylinder block, the pistons supportable on a housing-secured cam ring and each piston bounding a cylinder space in the cylinder block, wherein the cylinder spaces are connectable to a first and second main port via a housing-secured distributor configured to supply pressure medium, wherein a core element is inserted into the distributor and is configured to connect the distributor to the first and second main ports, the core element configured for rotation relative to the distributor, wherein at least one of a flushing valve, a pressure-maintaining valve, and a nonreturn valve for the first main port is arranged in the distributor, wherein a nonreturn valve for the second main port is arranged in the distributor, and wherein a respective valve bore is provided for a respective nonreturn valve, which valve bores extend approximately parallel to the longitudinal axis of the distributor.

14. The hydrostatic radial piston machine according to claim 13, wherein the valve bore for the first nonreturn valve extends from a first end side of the distributor, and/or wherein the valve bore for the second nonreturn valve extends from a second end side of the distributor.

15. The hydrostatic radial piston machine according to claim 13, wherein the valve bore of the second nonreturn valve is connected to the first annular groove via a connecting bore and/or the valve bore of the first nonreturn valve is connected to the second annular groove via a connecting bore.

* * * * *